US007958601B2

(12) United States Patent
Yu et al.

(10) Patent No.: US 7,958,601 B2
(45) Date of Patent: Jun. 14, 2011

(54) FOLDABLE HANDRAIL STRUCTURE

(75) Inventors: Fu-Sian Yu, Taipei (TW); Xiao-Long Mo, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 52 days.

(21) Appl. No.: 12/490,313

(22) Filed: Jun. 24, 2009

(65) Prior Publication Data

US 2009/0315008 A1 Dec. 24, 2009

Related U.S. Application Data

(60) Provisional application No. 61/075,017, filed on Jun. 24, 2008.

(51) Int. Cl.
*F16C 11/10* (2006.01)

(52) U.S. Cl. ..... 16/343; 256/67; 5/99.1; 16/323; 403/102; 403/321; 403/322.1; 403/218

(58) Field of Classification Search ..... 16/370, 16/360, 326, 342–348, 323, 325; 5/99.1, 5/93.2, 98.1, 110–111, 103; 403/100–102, 403/325, 65, 81, 321, 322.1, 218, 322.3; 256/67

See application file for complete search history.

(56) References Cited

U.S. PATENT DOCUMENTS

| | | | | |
|---|---|---|---|---|
| 5,241,716 | A | 9/1993 | Kohus | |
| 6,202,229 | B1 * | 3/2001 | Cheng | 5/99.1 |
| 7,108,443 | B2 * | 9/2006 | Chen | 403/102 |
| 7,284,288 | B2 * | 10/2007 | Cheng | 5/98.1 |
| 7,380,311 | B2 * | 6/2008 | Chen | 16/326 |
| 2003/0061658 | A1 * | 4/2003 | Longenecker | 5/99.1 |
| 2005/0147463 | A1 | 7/2005 | Chen | |
| 2006/0021136 | A1 * | 2/2006 | Cheng | 5/99.1 |
| 2007/0186344 | A1 | 8/2007 | Cheng | |

FOREIGN PATENT DOCUMENTS

| | | | |
|---|---|---|---|
| CN | 2677682 | Y | 2/2005 |
| FR | 2 794 009 | A1 | 12/2000 |
| GB | 2 434 178 | A | 7/2007 |

* cited by examiner

*Primary Examiner* — Jeanette E. Chapman
(74) *Attorney, Agent, or Firm* — Winston Hsu; Scott Margo

(57) ABSTRACT

A foldable handrail structure includes a casing, a first handrail member and a first locking member. The first handrail member is rotatably connected to the casing. The first locking member is rotatably disposed in the casing. The first locking member is capable of rotating between a first locked position and a first unlocked position, so as to selectively restrain the first handrail member from rotating.

10 Claims, 8 Drawing Sheets

FOLDABLE HANDRAIL STRUCTURE

CROSS REFERENCE TO RELATED APPLICATIONS

This application claims the benefit of U.S. Provisional Applications No. 61/075,017, which was filed on Jun. 24, 2008, and is incorporated herein by reference.

BACKGROUND OF THE INVENTION

1. Field of the Invention

The invention relates to a foldable handrail structure and, more particularly, to a foldable handrail structure with simple construction and user-friendly operation. Furthermore, the foldable handrail structure can be applied to a playard.

2. Description of the Prior Art

For a parent or other care giver, a playard is a practical tool for securing infants or children. In general, the playard provides rest or entertainment space for infants or children. To reduce space occupied by the playard for shipment and storage, most of the playards are foldable so far and the size of the playard can be reduced after being folded. Furthermore, to protect infants or children from harm, the playard has to be kept open while it is being used. In other words, a support frame of the playard should have functions of support and locking while the playard is being used, so as to keep the playard in stable state.

SUMMARY OF THE INVENTION

An objective of the invention is to provide a foldable handrail structure with simple construction and user-friendly operation. The foldable handrail structure can be applied to a playard, such that the playard can be easily folded and the size of the playard can be reduced after being folded.

According to an embodiment of the invention, the foldable handrail structure comprises a casing, a first handrail member and a first locking member. The first handrail member is rotatably connected to the casing. The first locking member is rotatably disposed in the casing. The first locking member is capable of rotating between a first locked position and a first unlocked position, so as to selectively restrain the first handrail member from rotating. Furthermore, the first locking member comprises a first engaging groove and the first handrail member comprises a first engaging portion. The first engaging portion is engaged with the first engaging groove when the first locking member is located at the first locked position.

In this embodiment, the foldable handrail structure can further comprise a second handrail member and a second locking member. The second handrail member is rotatably connected to the casing and opposite to the first handrail member. The second locking member is rotatably disposed in the casing and opposite to the first locking member. The second locking member is capable of rotating between a second locked position and a second unlocked position, so as to selectively restrain the second handrail member from rotating. Furthermore, the second locking member comprises a second engaging groove and the second handrail member comprises a second engaging portion. The second engaging portion is engaged with the second engaging groove when the second locking member is located at the second locked position.

In this embodiment, the foldable handrail structure can further comprise a first connecting member, the first locking member comprises a first connecting portion, and the second locking member comprises a second connecting portion. The first connecting portion is rotatably connected to the second connecting portion by the first connecting member, such that the first and second locking members are capable of rotating simultaneously. Furthermore, the first connecting member is capable of moving with respect to the casing The foldable handrail structure can further comprise a torsion spring attached on the first connecting member. Both ends of the torsion spring abut against the first and second locking members respectively. The foldable handrail structure can further comprise a driving member movably disposed in the casing and located under the first and second connecting portions. The driving member is capable of driving the first and second locking members simultaneously to move from the first and second locked positions to the first and second unlocked positions The foldable handrail structure can further comprise a resilient member disposed between the casing and the driving member.

In this embodiment, the driving member comprises a sloping surface and a press portion. The sloping surface abuts against the first and second connecting portions, and the press portion is exposed out of the casing. The foldable handrail structure can further comprise a socket attached on the casing. The socket has an opening and the press portion of the driving member passes through the opening so as to be exposed out of the casing. The foldable handrail structure can further comprise two second connecting members used for fixing the socket on the casing. The driving member comprises two sliding grooves formed on both ends thereof. Each of the second connecting members is disposed in one of the sliding grooves correspondingly, such that the driving member is movably sandwiched in between the two second connecting members.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
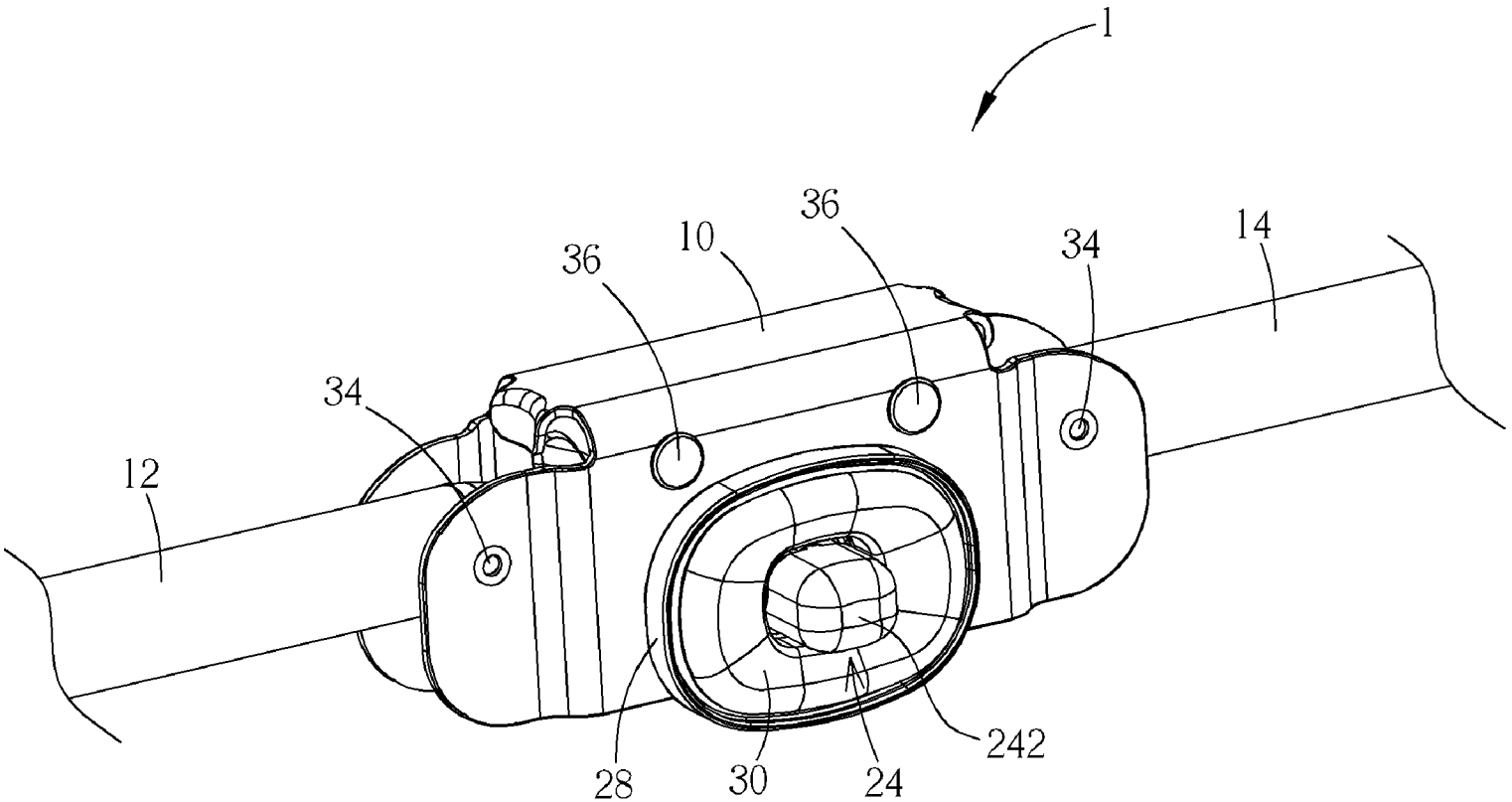
FIG. 1 is a perspective view illustrating an embodiment of the invention.
Figure 2:
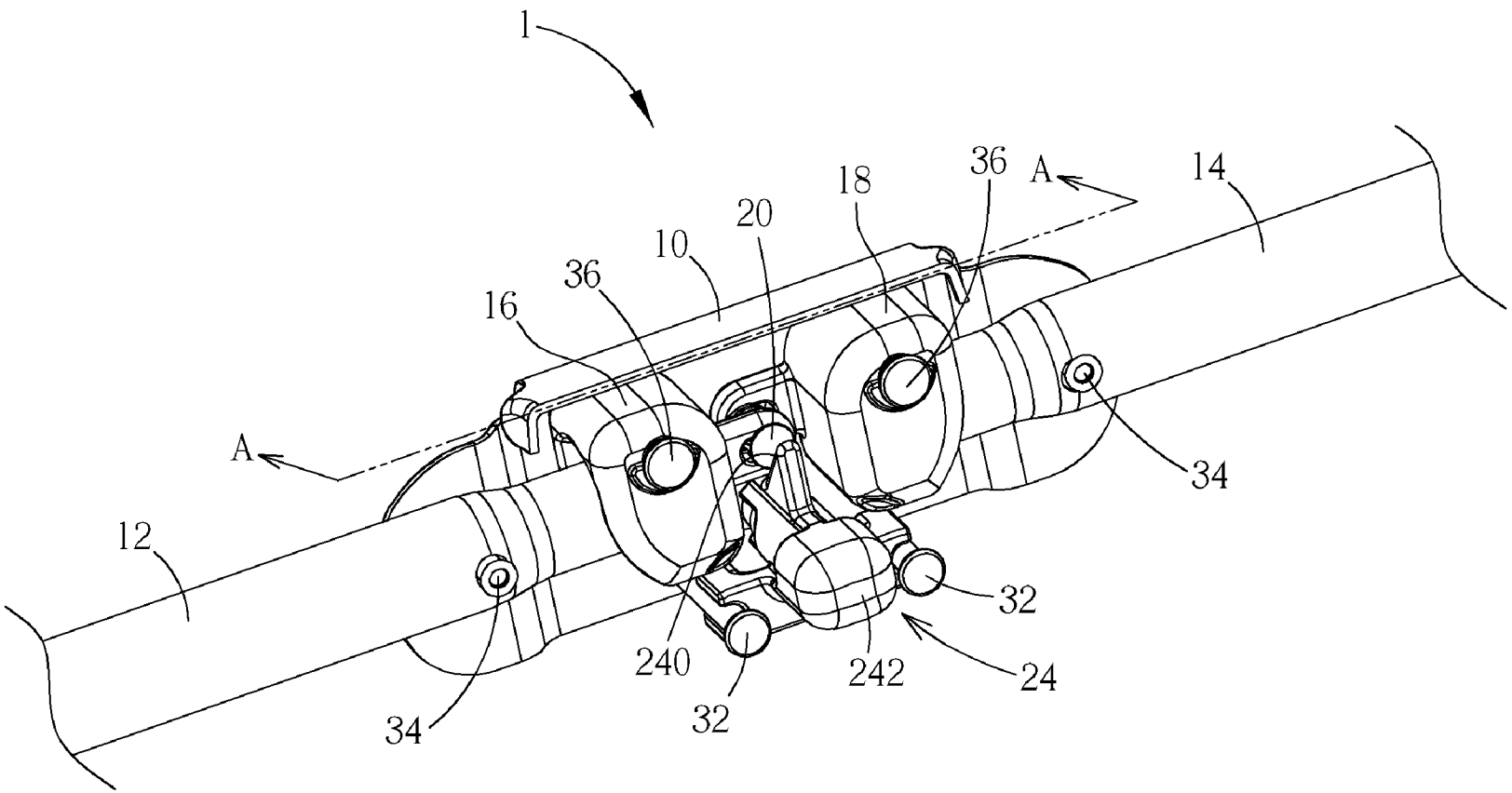
FIG. 2 is an assembly drawing illustrating inner components of an embodiment of the invention.
Figure 3:
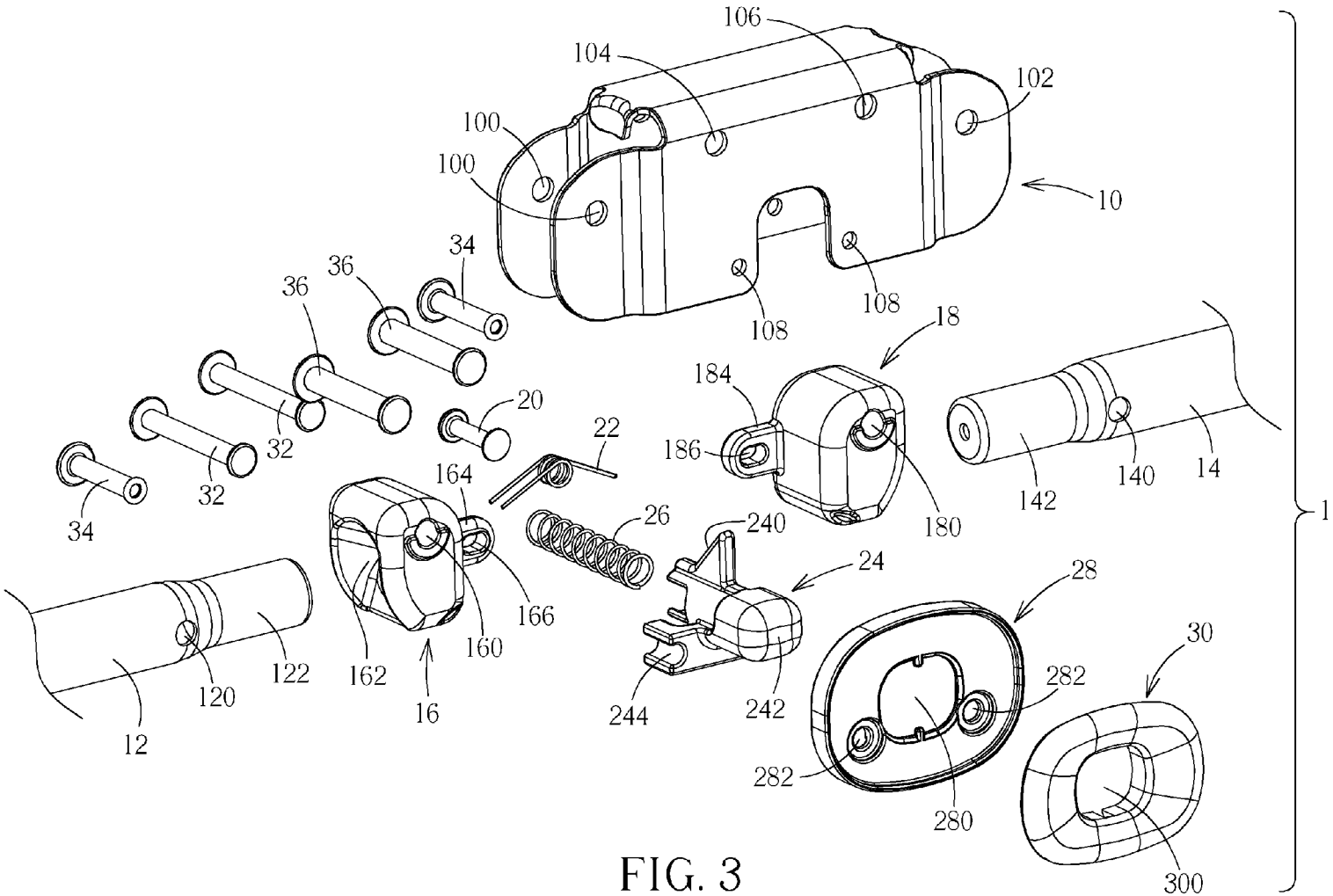
FIG. 3 is an exploded view illustrating an embodiment of the invention.

Referring to FIGS. 1 to 3, the foldable handrail structure 1 of the invention can be applied to (but not limited to) a playard, such that the playard can be easily folded and the size of the playard can be reduced after being folded. Furthermore, the foldable handrail structure 1 of the invention can be applied to any apparatus or equipment equipped with handrail or the like.

As shown in FIGS. 1 to 3, the foldable handrail structure 1 comprises a casing 10, a first handrail member 12, a second handrail member 14, a first locking member 16, a second locking member 18, a first connecting member 20, a torsion spring 22, a driving member 24, a resilient member 26, a socket 28, a cover 30, two second connecting members 32, two third connecting members 34 and two fourth connecting members 36.

The casing 10 has substantially inversed U-shape. One third connecting member 34 can be inserted into two holes 100 formed on one side of the casing 10 and a hole 120 formed on the first handrail member 12, such that the first handrail member 12 can be rotatably connected to the casing 10. Similarly, the other third connecting member 34 can be inserted into two holes 102 formed on the other side of the casing 10 and a hole 140 formed on the second handrail member 14, such that the second handrail member 14 can be rotatably connected to the casing 10. Furthermore, one fourth connecting member 36 can be inserted into two holes 104 formed on the front and back of the casing 10 and a hole 160 formed on the first locking member 16, such that the first locking member 16 can be rotatably disposed in the casing 10. Accordingly, the first locking member 16 is capable of rotating between a first locked position and a first unlocked position, so as to selectively restrain the first handrail member 12 from rotating. Similarly, the other fourth connecting member 36 can be inserted into two holes 106 formed on the front and back of the casing 10 and a hole 180 formed on the second locking member 18, such that the second locking member 18 can be rotatably disposed in the casing 10. Accordingly, the second locking member 18 is capable of rotating between a second locked position and a second unlocked position, so as to selectively restrain the second handrail member 14 from rotating. In this embodiment, the second handrail member 14 is opposite to the first handrail member 12, and the second locking member 18 is opposite to the first locking member 16.

The first locking member 16 comprises a first connecting portion 164 and the second locking member 18 comprises a second connecting portion 184. The first connecting member 20 is inserted into a hole 166 formed on the first connecting portion 164 and a hole 186 formed on the second connecting portion 184. It should be noted that the first connecting member 20 does not be connected to the casing 10. That is to say, the first connecting portion 164 is rotatably connected to the second connecting portion 184 by the first connecting member 20 and the first connecting member 20 can move with respect to the casing 10 while the two locking members 16 and 18 rotate. Accordingly, the first and second locking members 16 and 18 are capable of rotating simultaneously. Furthermore, the torsion spring 22 is attached on the first connecting member 20, wherein both ends of the torsion spring 22 abut against the first and second locking members 16 and 18 respectively. Moreover, the torsion spring 22 can move with respect to the casing 10 while the first connecting member 20 is moving.

The driving member 24 is movably disposed in the casing 10 and located under the first and second connecting portions 164 and 184. The driving member 24 comprises a sloping surface 240 and a press portion 242. The sloping surface 240 abuts against the first and second connecting portions 164 and 184, and the press portion 242 is exposed out of the casing 10. The press portion 242 of the driving member 24 can be operated to move toward an inner of the casing 10, so as to drive the first and second locking members 16 and 18 simultaneously to move from the first and second locked positions to the first and second unlocked positions. The resilient member 26 is disposed between the casing 10 and the driving member 24. The driving member 24 has an accommodating space for accommodating the resilient member 26, so the resilient member 26 can be stably disposed between the casing 10 and the driving member 24. When the press portion 242 of the driving member 24 pressed, the resilient member 26 generates an elastic force for getting the driving member 24 back to the position before being pressed. The resilient member 26 can be, but not limited to, a spring.

The socket 28 is attached on the outside of the casing 10 and the cover 30 is attached on the socket 28. The socket 28 has an opening 280 and the cover 30 has an opening 300. The press portion 242 of the driving member 24 passes through the opening 280 of the socket 28 and the opening 300 of the cover 30 so as to be exposed out of the casing 10. Furthermore, the two second connecting members 32 are inserted into the holes 282 formed on the socket 28 and the holes 108 formed on the casing 10 respectively so as to fix the socket 28 on the casing 10. The driving member 24 comprises two sliding grooves 244 formed on both lateral ends thereof. It should be noted that FIG. 3 only shows one sliding groove 244 on one side of the driving member 24 due to an angle of view. When the driving member 24 is disposed in the casing 10, each of the second connecting members 32 is disposed in one of the sliding grooves 244 correspondingly, such that the driving member 24 is movably sandwiched in between the two second connecting members 32 and is able to move in the direction parallel with the axial direction of the two second connecting members 32. In other words, when the press portion 242 of the driving member 24 is pressed, the driving member 24 will move along the second connecting members 32 and toward the inner of the casing 10.

Figure 4:
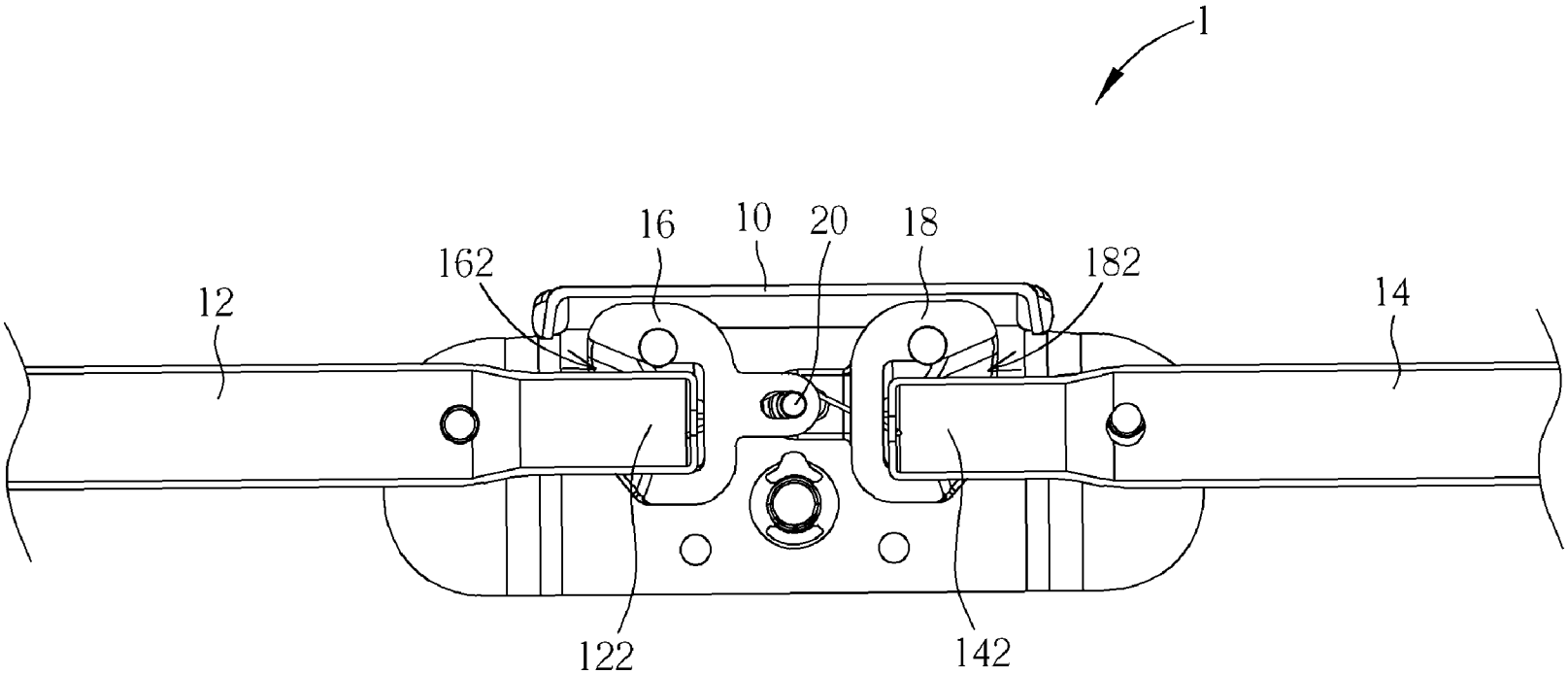
FIG. 4 is a sectional view illustrating the embodiment shown in FIG. 2 along line A-A.
Figure 5:
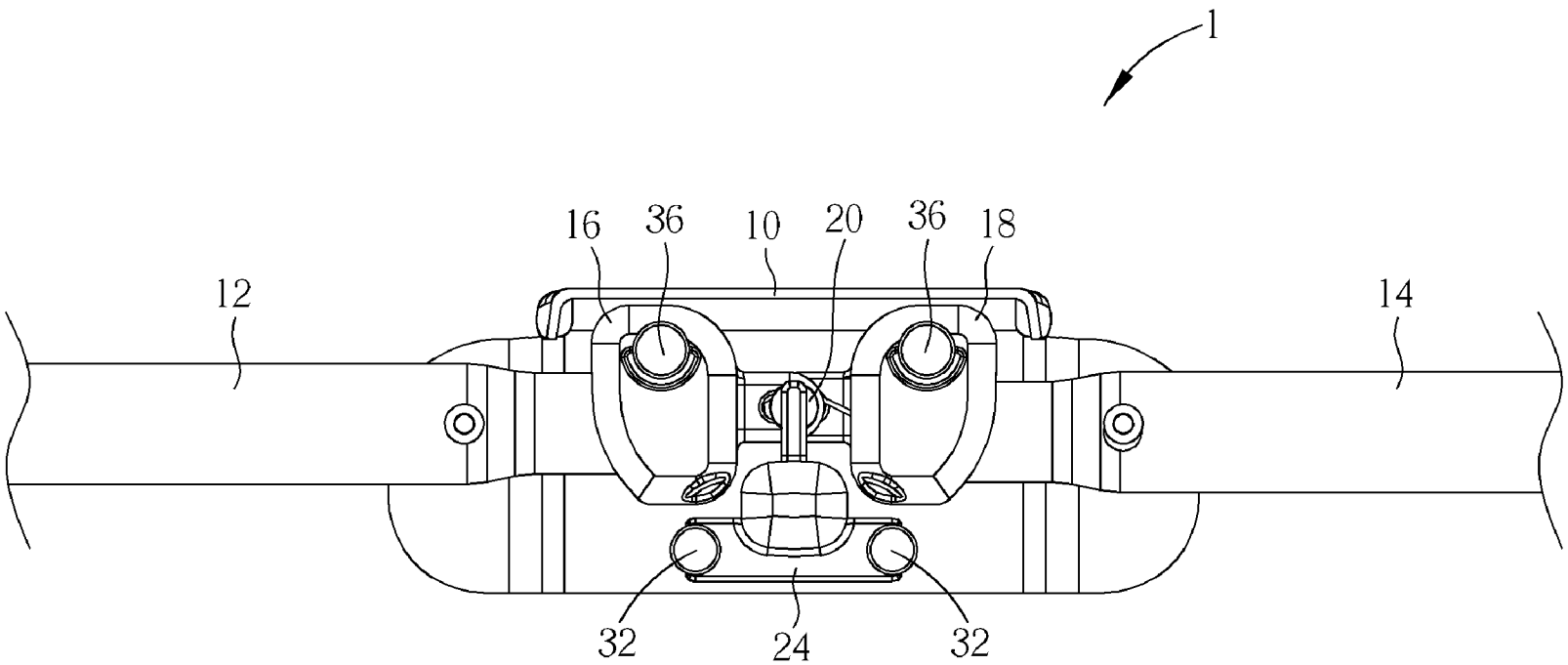
FIG. 5 is a side view illustrating the embodiment shown in FIG. 2.

Please refer to FIGS. 4 and 5. The first locking member 16 comprises a first engaging groove 162 and the first handrail member 12 comprises a first engaging portion 122. The first engaging portion 122 is engaged with the first engaging groove 162 when the first locking member 16 is located at the first locked position, as shown in FIG. 4. Furthermore, the second locking member 18 comprises a second engaging groove 182 and the second handrail member 14 comprises a second engaging portion 142. The second engaging portion 142 is engaged with the second engaging groove 182 when the second locking member 18 is located at the second locked position, as shown in FIG. 4. Before pressing the driving member 24, the foldable handrail structure 1 of the invention is situated at a locking state. At this time, the first and second handrail members 12 and 14 are restrained by the first and second locking members 16 and 18 respectively and kept at a horizontal position. Consequently, the first and second handrail members 12 and 14 cannot be operated to rotate.

Figure 6:
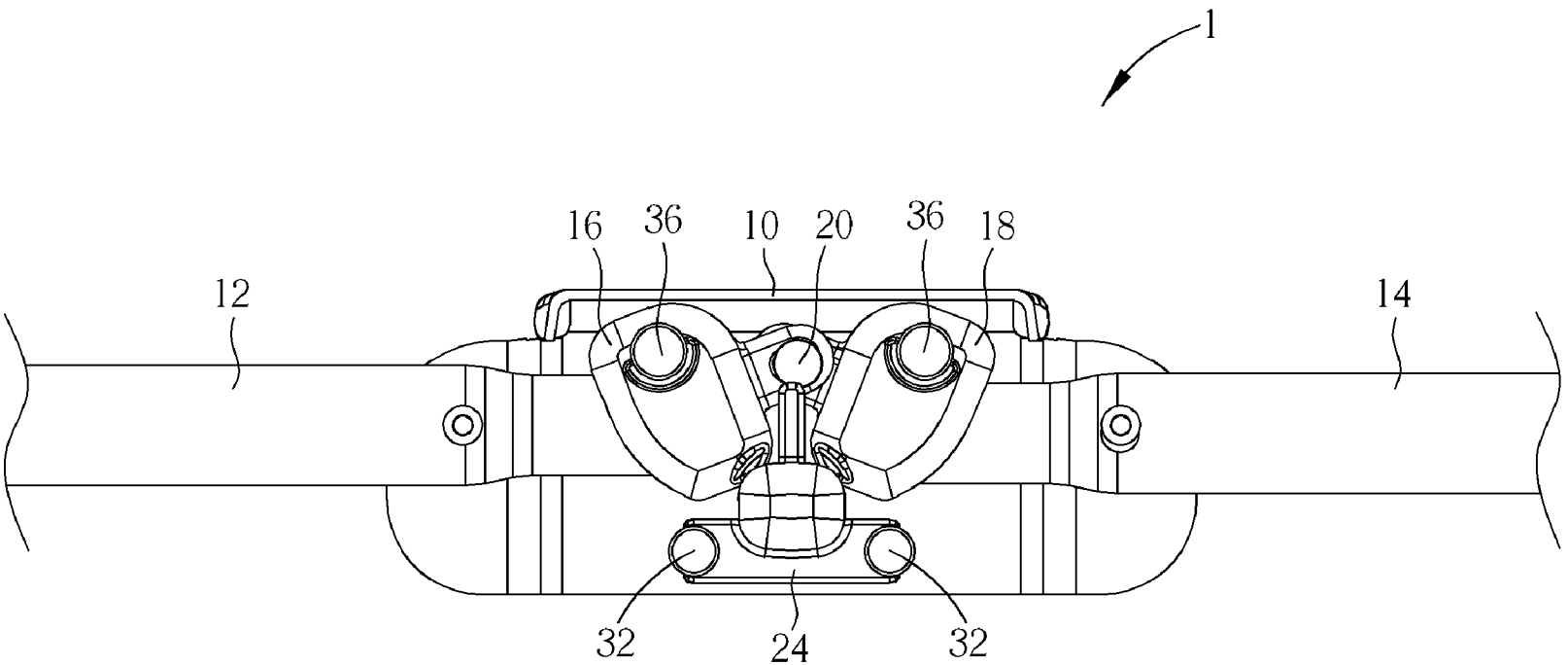
FIG. 6 is a schematic diagram illustrating the driving member shown in FIG. 5 after being pressed.
Figure 7:
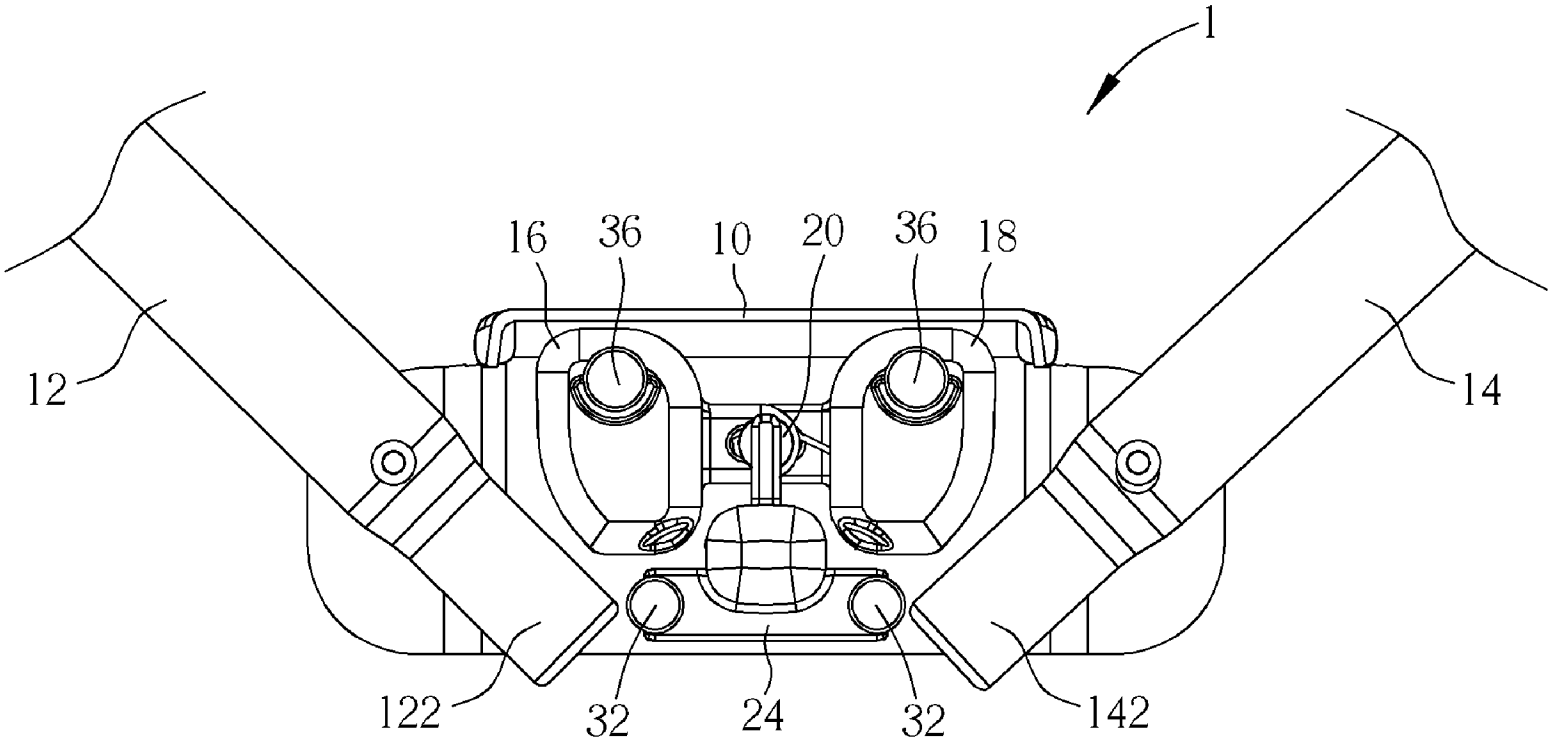
FIG. 7 is a schematic diagram illustrating the first and second handrail members shown in FIG. 6 after being rotated.
Figure 8:
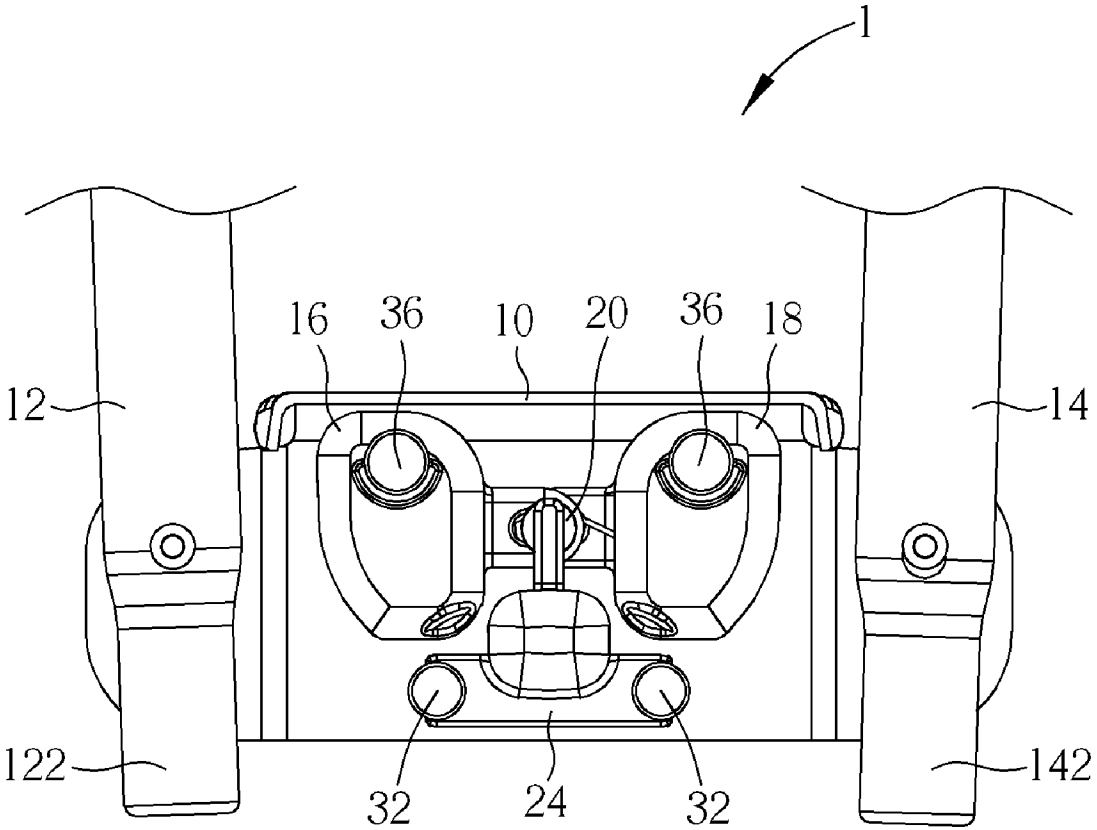
FIG. 8 is a schematic diagram illustrating the foldable handrail structure situated at a folded state.

Please refer to FIGS. 6 to 8. When the press portion 242 of the driving member 24 is pressed by an external force, the driving member 24 will move along the second connecting members 32 and toward the inner of the casing 10. At this time, the sloping surface 240 of the driving member 24 will push the first and second locking members 16 and 18, such that the first and second locking members 16 and 18 will rotate toward each other with respect to the fourth connecting members 36. Since the first locking member 16 is connected to the second locking member 18 by the first connecting member 20, the driving member 24 can push one of the first and second locking members 16 and 18 or both of them. Then, the first and second locking members 16 and 18 will rotate simultaneously from the first and second locked positions shown in FIG. 5 to the first and second unlocked positions shown in FIG. 6. Afterward, the user only needs to rotate the first and second handrail members 12 and 14 and then the foldable handrail structure 1 will be converted from an expanded state shown in FIG. 5 to a folded state shown in FIG. 8. It should be noted that the two handrail members 12 and 14 can be locked or unlocked simultaneously since the two locking members 16 and 18 are connected by the first connecting member 20, so as to avoid danger resulted from incompletely or unsteadily locked or unlocked situation. After rotating the two handrail members 12 and 14 and then releasing the external force from the driving member 24, the elastic force generated by the resilient member 26 will get the driving member 24 back to the position with no external force presses on and the elastic force generated by the torsion spring 22 will get the two locking members 16 and 18 back to the locked positions. Furthermore, the torsion spring also can assist in getting the driving member 24 back.

On the other hand, once the user wants to convert the foldable handrail structure 1 from the folded state shown in FIG. 8 to the expanded state shown in FIG. 5, he or she only needs to expand the first and second handrail members 12 and 14 toward both ends horizontally. Then, the first and second engaging portions 122 and 142 will contact and push the first and second locking members 16 and 18 respectively, so that the first and second locking members 16 and 18 will rotate with respect to the fourth connecting members 36. At the same time, the first and second locking members 16 and 18 will force both ends of the torsion spring 22, such that the torsion spring 22 will generate an elastic force. When the first and second engaging portions 122 and 142 of the first and second handrail members 12 and 14 enter the first and second engaging grooves 162 and 182 of the first and second locking members 16 and 18 completely, the elastic force generated by the torsion 22 will make the first and second locking members 16 and 18 rotate inversely until the two locking members 16 and 18 get back to the locked positions.

Compared to the prior art, the foldable handrail structure of the invention can be easily folded and the size can be reduced after being folded. Furthermore, the foldable handrail structure of the invention has functions of support and locking while it is being used, so as to keep an apparatus or equipment equipped with the foldable handrail structure in stable state. Moreover, the two handrail members of the invention can be locked or unlocked simultaneously, so as to avoid danger resulted from incompletely or unsteadily locked or unlocked situation.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foldable handrail structure comprising:

a casing;

a first handrail member rotatably connected to the casing;

a first locking member rotatably disposed in the casing, the first locking member comprising a first connecting portion, the first locking member being capable of rotating between a first locked position and a first unlocked position, so as to selectively restrain the first handrail member from rotating;

a second handrail member rotatably connected to the casing and opposite to the first handrail member;

a second locking member rotatably disposed in the casing and opposite to the first locking member, the second locking member comprising a second connecting portion, the second locking member being capable of rotating between a second locked position and a second unlocked position, so as to selectively restrain the second handrail member from rotating;

a first connecting member, the first connecting portion being rotatably connected to the second connecting portion by the first connecting member, such that the first and second locking members are capable of rotating simultaneously; and a driving member movably disposed in the casing and located under the first and second connecting portions;

wherein when the driving member is pressed to move with respect to the casing and push at least one of the first and second connecting portions, the first and second locking members rotate simultaneously from the first and second locked positions to the first and second unlocked positions and the first connecting member moves simultaneously.

2. The foldable handrail structure of claim 1, wherein the first locking member comprises a first engaging groove, the first handrail member comprises a first engaging portion, and the first engaging portion is engaged with the first engaging groove when the first locking member is located at the first locked position.

3. The foldable handrail structure of claim 1, wherein the second locking member comprises a second engaging groove, the second handrail member comprises a second engaging portion, and the second engaging portion is engaged with the second engaging groove when the second locking member is located at the second locked position.

4. The foldable handrail structure of claim 1, wherein the first connecting member is capable of moving with respect to the casing.

5. The foldable handrail structure of claim 4, further comprising a torsion spring attached on the first connecting member, wherein both ends of the torsion spring abut against the first and second locking members respectively.

6. The foldable handrail structure of claim 1, further comprising a resilient member disposed between the casing and the driving member.

7. The foldable handrail structure of claim 1, wherein the driving member comprises a sloping surface and a press portion, the sloping surface abuts against the first and second connecting portions, and the press portion is exposed out of the casing.

8. The foldable handrail structure of claim 7, further comprising a socket attached on the casing, wherein the socket has an opening and the press portion of the driving member passes through the opening so as to be exposed out of the casing.

9. The foldable handrail structure of claim 8, further comprising two second connecting members used for fixing the socket on the casing.

10. The foldable handrail structure of claim 9, wherein the driving member comprises two sliding grooves formed on both lateral ends thereof, and each of the second connecting members is disposed in one of the sliding grooves correspondingly, such that the driving member is movably sandwiched in between the two second connecting members.

* * * * *